US007823976B2

(12) United States Patent
Mackert

(10) Patent No.: US 7,823,976 B2
(45) Date of Patent: Nov. 2, 2010

(54) CHAIR

(75) Inventor: Michael Mackert, Rüthen (DE)

(73) Assignee: Kintec-Solution GmbH, Geseke (DE)

( * ) Notice: Subject to any disclaimer, the term of this patent is extended or adjusted under 35 U.S.C. 154(b) by 0 days.

(21) Appl. No.: 12/093,848

(22) PCT Filed: Jul. 7, 2006

(86) PCT No.: PCT/EP2006/064011

§ 371 (c)(1),
(2), (4) Date: Sep. 5, 2008

(87) PCT Pub. No.: WO2007/057237

PCT Pub. Date: May 24, 2007

(65) Prior Publication Data

US 2009/0091173 A1 Apr. 9, 2009

(30) Foreign Application Priority Data

Nov. 17, 2005 (DE) ..... 20 2005 017 987 U

(51) Int. Cl.
*A47C 1/024* (2006.01)

(52) U.S. Cl. ..... 297/301.1; 297/301.2; 297/301.5; 297/301.7

(58) Field of Classification Search ..... 297/301.1, 297/301.2, 301.5, 301.7; 267/64.11–64.28
See application file for complete search history.

(56) References Cited

U.S. PATENT DOCUMENTS 4,004,836 A * 1/1977 Kristensson ..... 297/362.13
4,471,994 A * 9/1984 Zund et al. ..... 297/300.3
4,813,743 A * 3/1989 Mizelle ..... 297/301.2
5,015,032 A * 5/1991 Felling ..... 297/301.2
5,174,551 A 12/1992 Mintgen
5,176,601 A * 1/1993 Reynolds ..... 482/130
5,342,112 A 8/1994 Padovan
5,450,933 A * 9/1995 Schuttler ..... 188/300
5,658,045 A * 8/1997 Van Koolwijk et al. .. 297/300.5
5,833,218 A * 11/1998 Sand ..... 267/64.25
5,988,608 A * 11/1999 Koch ..... 267/120
6,234,573 B1 * 5/2001 Roder et al. ..... 297/300.5
6,491,143 B1 * 12/2002 Stenquist ..... 188/269

(Continued)

FOREIGN PATENT DOCUMENTS

DE 0 592 369 A1 10/1993

(Continued)

OTHER PUBLICATIONS

German Search Report completed Jan. 12, 2006, from corresponding Patent Cooperation Treaty (PCT) Application No. PCT/EP2006/064011, dated May 27, 2004.

(Continued)

*Primary Examiner*—David Dunn
*Assistant Examiner*—Erika Garrett
(74) *Attorney, Agent, or Firm*—Van Dyke, Gardner, Linn & Burkhart, LLP

(57) ABSTRACT

A chair includes a backrest and a seat surface. The backrest is adjustable relative to the seat surface, and the backrest is adjustable in its inclination independently of the position of the seat surface. The adjustment of the inclination of the backrest occurs in a stepless manner and without an operating mechanism.

9 Claims, 3 Drawing Sheets

U.S. PATENT DOCUMENTS

| | | | | |
|---|---|---|---|---|
| 6,659,555 | B1 * | 12/2003 | Scholz et al. | 297/302.2 |
| 6,695,404 | B2 * | 2/2004 | Bruske | 297/316 |
| 6,857,610 | B1 * | 2/2005 | Conner et al. | 248/284.1 |
| 6,896,327 | B1 * | 5/2005 | Barile, Sr. | 297/297 |
| 7,059,592 | B2 * | 6/2006 | Huh et al. | 267/64.12 |
| 7,093,900 | B1 * | 8/2006 | Schon | 297/344.11 |
| 7,322,653 | B2 * | 1/2008 | Dragusin | 297/300.3 |
| 7,328,875 | B2 * | 2/2008 | Kastner et al. | 248/161 |
| 2002/0108825 | A1 * | 8/2002 | Miller et al. | 188/280 |
| 2008/0116622 | A1 * | 5/2008 | Fox | 267/64.28 |

FOREIGN PATENT DOCUMENTS

| | | | |
|---|---|---|---|
| DE | 200 10 356 | U1 | 10/2000 |
| DE | 202005006216 | U1 | 7/2005 |
| EP | 0465887 | A1 | 1/1992 |
| EP | 0562305 | A1 | 9/1993 |
| FR | 2786536 | A1 | 6/2000 |
| RU | 2180413 | C2 | 10/2001 |

OTHER PUBLICATIONS

International Search Report and Written Opinion of the International Searching Authority from corresponding Patent Cooperation Treaty (PCT) Application No. PCT/EP06/64011, mailed Nov. 3, 2006.

* cited by examiner

CHAIR

CROSS REFERENCE TO RELATED APPLICATION

This application claims the priority benefits of International Application No. PCT/EP2006/064011, filed on Jul. 7, 2006, which is hereby incorporated herein by reference in its entirety.

BACKGROUND OF THE INVENTION

The present invention is directed to a chair with a backrest which can be adjusted relative to a seat surface, and, in particular, to such a chair in which the backrest can be adjusted in its inclination independently of the position of the seat of the chair.

Chairs are known that are adjustable between a sitting and a reclining position. These are also known as sitting and reclining furniture. They allow an adjustment of the position between a "normal" upright sitting position and a generally horizontally oriented reclining position. An adjusted inclination of the backrest is maintained or the inclination of the backrest can be adjusted separately and independently of the position of the chair.

German Patent Application No. DE 296 00 282 U1 discloses a chair in which it is possible to perform the adjustment by moving the seat surface without substantial force, since a parallel linkage system moves the body weight or the center of gravity backward along with the seat surface when the seat surface is shifted. The inclination of the backrest is adjusted by a gas pressure spring controlled via a valve, and the valve is activated via an operating lever.

Another chair is known from the firm Steltemeier GmbH located in Lippstadt. In this chair as well, an adjustment of the inclination of the backrest occurs via a gas pressure spring and is controlled by means of operating lever and valve.

In such chairs the mechanism associated with the operating lever may be complicated and prone to breakdown. Furthermore, the user often must operate the lever to adjust the inclination, which may be difficult in the reclining position. Moreover, the operating of the lever may not always be intuitive, depending on its design, and so the user may need to have this explained to him or her.

SUMMARY OF THE INVENTION

The present invention, according to the illustrated embodiment, provides a chair in which the inclination of the backrest is possible in an especially easy manner and in which furthermore the mechanism for the adjustment of the backrest is simple and robust in design, as well as intuitive in operation.

Accordingly, the chair is designed so that the adjustment of the inclination of the backrest occurs in a stepless manner without operating mechanisms, and the operation is simple and intuitive. Moreover, the construction of the chair is simplified and thus it is robust, as well as economical, in its manufacture.

Operating mechanisms may include levers, screws, buttons, wheels, knobs, handles and the like, to be operated by the user, which when activated allow a changing of the inclination of the backrest, for which they activate, for example, valves of gas pressure springs, or release locking mechanisms or detent means. In addition, operating mechanisms may include mechanical devices which enable an adjustment of the inclination of the backrest only after a releasing of a detent device by pressure against the backrest. One example of such a device is the use of a detent roller, which in the upright position of the backrest is held in a recess and needs to be forced out with a certain amount of force in order to make possible the movement of the backrest.

In the illustrated embodiment, neither an operating lever nor a locking or detent means is required.

The adjustment of the inclination may be configured such that the backrest can additionally be supported in any desired position. When so configured, it is possible to hold or adjust the backrest in various positions not only in a stepless manner, but also with no particular activation or locking or detent means. Thus, the backrest can be tilted into any desired position and supported there, when the user leans back.

In one aspect of the invention, a gas pressure spring is provided for adjusting the inclination of the backrest, which is provided with an elevated initial push-in force regardless of its respective position. Such a gas pressure spring may have a certain initial force has to be overcome to move the piston of the gas pressure spring, after which the further adjustment can occur with a smaller force. Such a gas pressure spring thus serves for force assistance and stepless positioning of the backrest and also ensures that the backrest is supported in every position with the user leaning back on it.

In another aspect, the gas pressure spring is a friction gas spring or a gas pressure spring with a pressure valve at the back side of the piston. Friction gas springs may have an extra element with friction which must be overcome in order to move it. Such elements may be foam materials, which lie against the wall of the tube under a prestressing force and thus generate extra friction. In addition, gas pressure springs may have a piston outfitted with a pressure valve arranged on the back side of the piston, wherein the valve hinders the exchange or the pushing in of the piston rod until a spring-loaded gasket releases the piston bore.

Such gas pressure springs are available, for example, from the firms STABILUS GmbH located in Koblenz, Germany, or SUSPA GmbH located in Altdorf, Germany.

Thus, in order to achieve an adjustment of the inclination of the brackrest, the user only needs to lean back and overcome the initial force of the gas pressure spring by an additional pressing, e.g., against the arm rests. Then the user leans back as much as desired and only needs to halt the movement of the backrest in order to fix its position. If the user wishes to further increase the inclination, he can lean back again, overcoming the initial force, in order to achieve a further adjustment of the backrest.

According to another aspect of the invention, the gas pressure spring has a smaller push-out force than the push-in force. If the user would like to sit upright or reduce the inclination of the backrest or make the backrest more upright, the user only need lean forward. Despite the reduced push-out force, it is large enough to restore the backrest to a more upright position.

The spring characteristics may be chosen so that the forces are adequate for persons of normal weight, i.e., they must apply a slight additional support pressure to accomplish the respective adjustment.

These and other features, properties and advantages of the present invention will become apparent from the following specification in conjunction with the drawings.

DESCRIPTION OF THE PREFERRED EMBODIMENT

Figure 1:
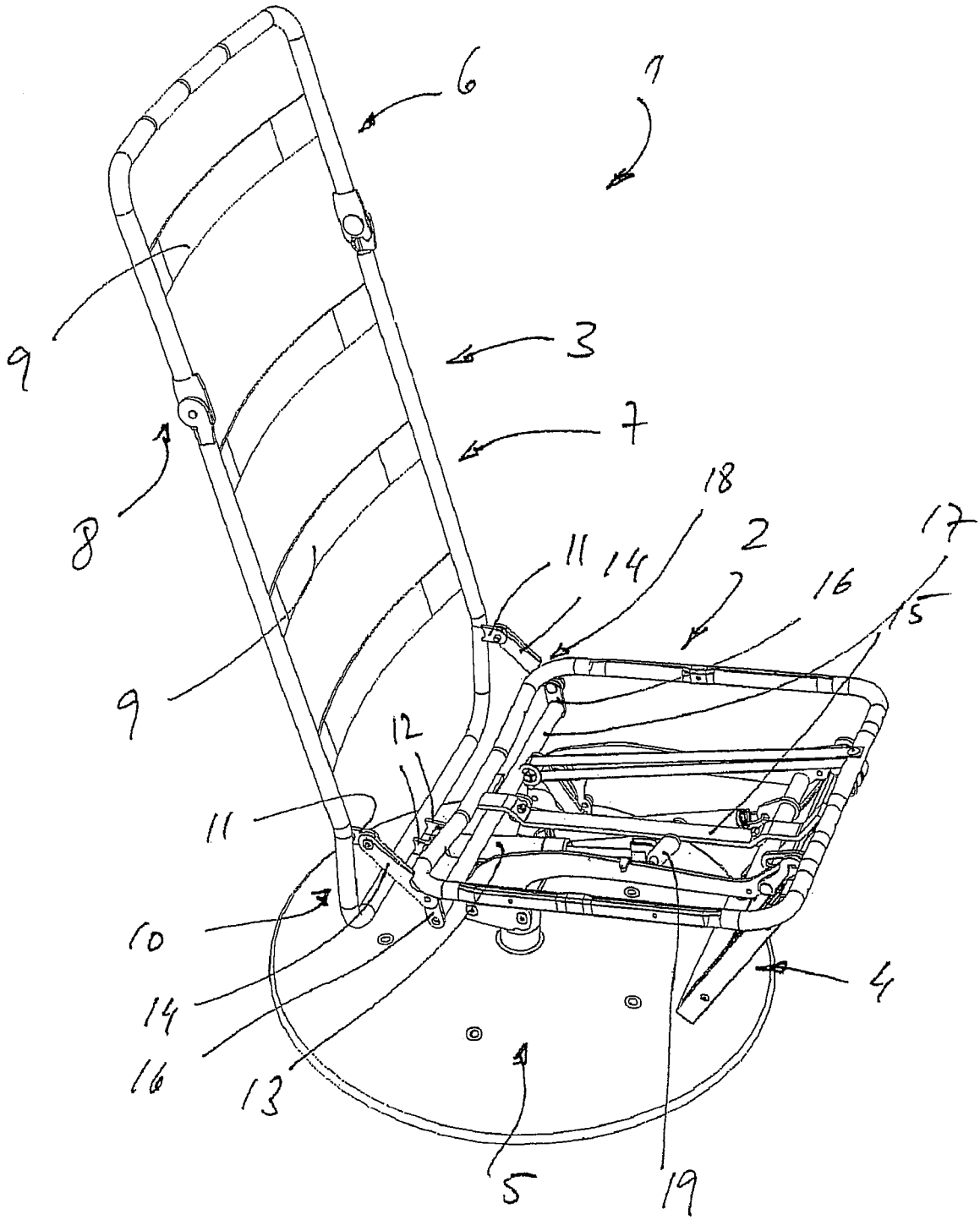
FIG. 1 is a perspective view of a chair according to the present invention, shown without upholstery and with the backrest erect.
Figure 2:
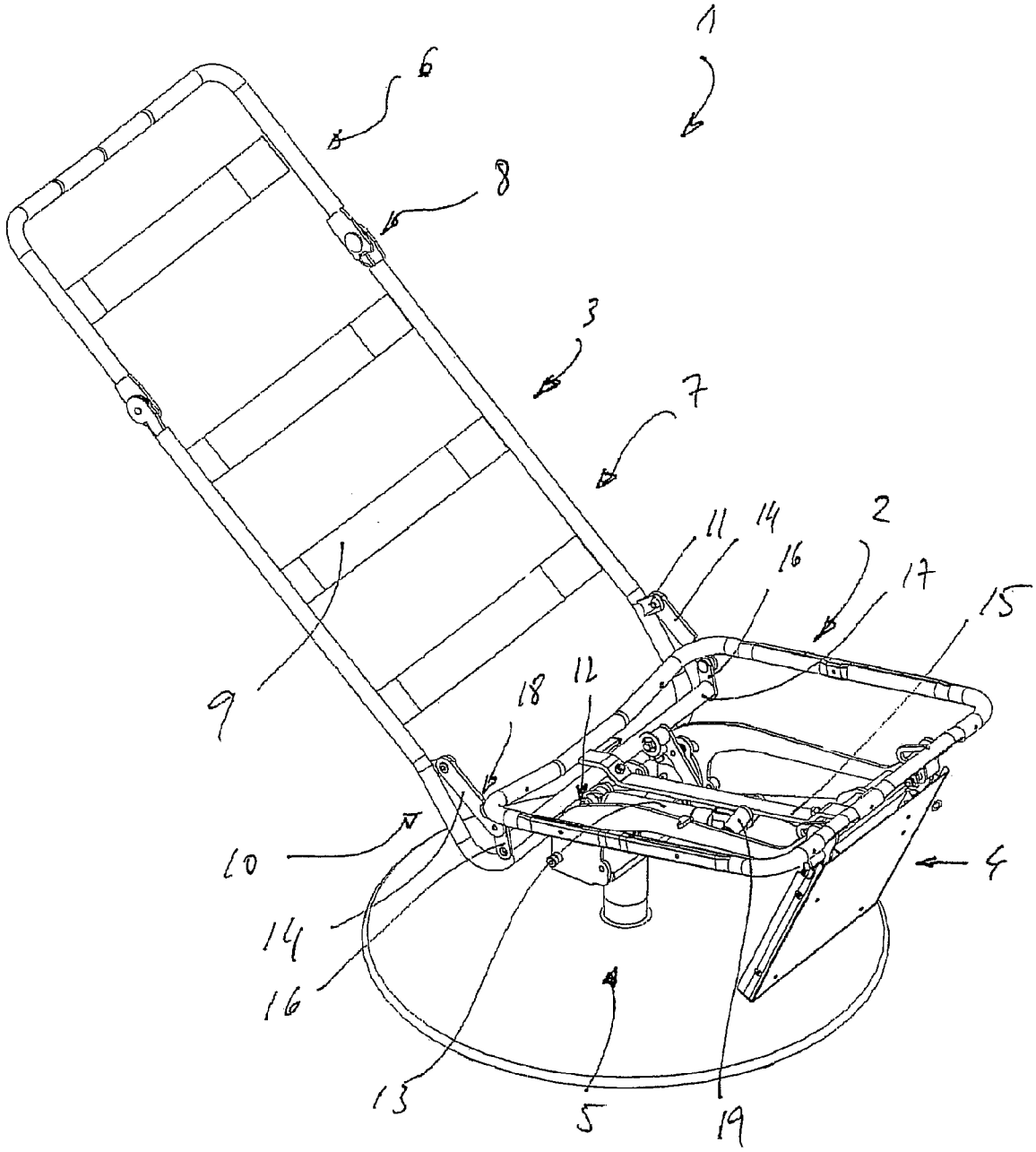
FIG. 2 is a perspective view of the chair of FIG. 1, shown with the backrest inclined.

FIGS. 1 and 2 show a view according to an illustrative embodiment, of chair 1 shown from a slanting left top perspective in the sitting position and without upholstery. For better clarity, only the basic frame of chair 1 and its mechanism are depicted. In FIG. 1, chair 1 is shown with an upright backrest, whereas the backrest in FIG. 2 is tilted back.

Chair 1 includes a seat surface 2, a backrest 3, a swiveling leg rest 4 and a base 5.

Seat surface 2 can be shifted via a suitable link system between a sitting and reclining position, while the leg rest 4 is extended from its folded position and swiveled back again. This does not affect the inclination of the backrest 3.

Backrest 3 includes a head piece 6 and a back piece 7, each being formed from a tube frame and being joined together via side locking linkages 8, and between the sides of the pieces are cross braces 9, forming a support surface for the lining or upholstery. Moreover, the chair 1 has a lower region 10, adjoining the back piece 7 at the bottom, forming a slight angle with the back piece 7. In the erect sitting position shown, the lower region 10 is generally vertical and the back piece 7 is tilted backward by approximately 15 degrees from the vertical.

Backrest 3 is connected via the lower region 10 to the seat surface 2 and its mechanism, while on either side corresponding brackets 11 and 12 are welded to the lower region 10 at the top and bottom, respectively. The brackets 11 are arranged on the outside at the transition between the back piece 7 and the region 10 and the brackets 12 are arranged with a slight distance from each other roughly in the center on the lower cross brace of the backrest 3.

The upper brackets 11 are each articulated to a lever 14, which in turn is articulated to another lever 16, which is rigidly joined by a round rod 17 to its counterpart on the other side. On the round rod 17 are welded two brackets, which are adapted for the articulation to the rest of the chair 1 or parts of its base 5.

The lever 14 arranged between the respective bracket 11 and the lever 16 has a roughly semicircular recess 18, which is adapted for the movable accommodation of the rear corner of the seat surface 2.

The lower brackets 12 are articulated to a gas pressure spring 13, which in turn is linked to a longitudinal brace 15 of the seat surface 2, arranged roughly in the middle between the front brace and the rear brace of the seat surface and being bent downwards in the edge region. Thus, the gas pressure spring 13 is connected, on the one hand, to the braces 12 and, on the other hand, to the longitudinal brace 15 via brackets 19.

The gas pressure spring 13 serves to adjust the inclination of the backrest 3, which can be adjusted independently of the seat surface 2.

Figure 3:
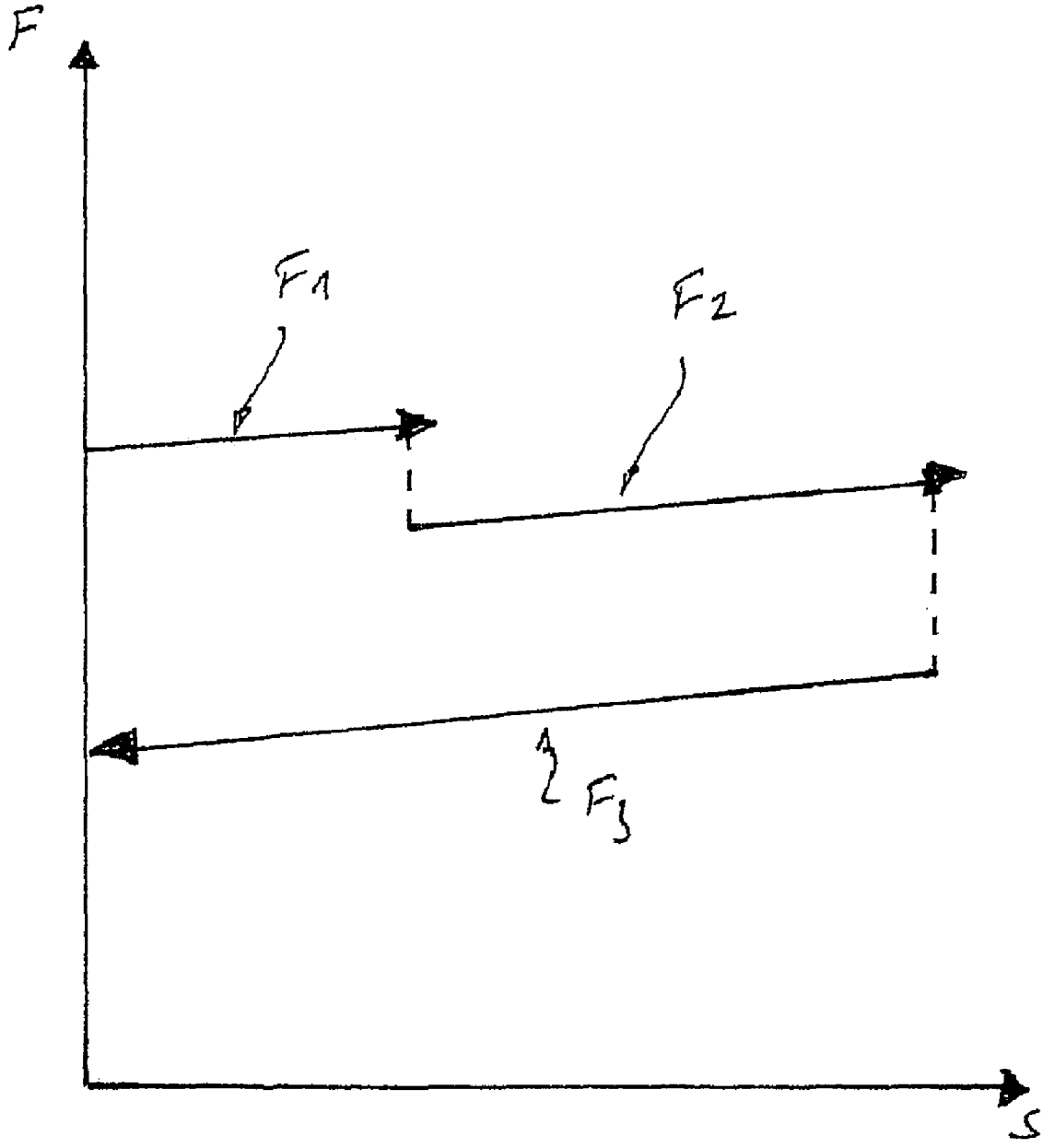
FIG. 3 is a schematic diagram illustrating characteristics of a gas pressure spring, according to the present invention, shown with an increased initial push-in force and a reduced push-out force.

The gas pressure spring 13 is a special gas pressure spring that is provided with an increased initial push-in force F1 regardless of its particular position (see FIG. 3).

Both friction gas springs and gas pressure springs with a pressure valve at the rear side of the piston may be used, such as are known by the names Hydro-Lift® from the Stabilus company.

Thus, to accomplish an adjustment of the inclination of the backrest 3, the user need only lean back and overcome the initial push-in force F1 of the gas pressure spring by an additional back push. After this, only the reduced push-in force F2 is still active and needs to be overcome, so that the user now need only lean back as much as desired to take up the desired position of the backrest 3.

At this point, the user simply lessens the pressure, so that the backrest 3 remains positioned at the adjusted position and is held there against the weight of the person, as a result of the increased initial push-in force F1 still exerted from standstill. Thus, the user can also lean against the backrest 3 in any given position of the backrest 3.

If the user wishes a further adjustment of the inclination, he can once again lean backward, overcoming the initial push-in force F1, and thereby accomplish the adjustment of the backrest 3.

In addition, the gas pressure spring 13 has a smaller push-out force F3 than the push-in force F2. This is because the push-out force F3 corresponds roughly to the push-in force F2 minus the friction.

If the user would like to sit up again or reduce the inclination of the backrest, or position the backrest 3 more steeply, the user need only lean forward. Thus, the push-out force F3 is chosen such that the backrest 3, while not "sliding" the user out from the chair 1, nevertheless restores itself.

The push-in forces F1 and F2, as with springs in general, increase slightly along the adjustment path. Accordingly, the push-out force F3 also decreases slightly along the adjustment path.

The spring characteristic (FIG. 3) of the gas pressure spring 13 may be chosen so that the forces F1, F2 and F3 are appropriate for persons of normal weight, i.e., these persons must exert a slight additional pressure by pushing off to tilt the backrest backward. Of course, the gas pressure spring may also be selected so that the chair 1 is suitable for heavier persons.

The chair 1 is thus configured so that the adjustment of the inclination of the backrest 3 occurs in a stepless manner without operating mechanisms. In addition, the adjustment of the inclination is configured such that the backrest 3 can be held in any given position. The adjustment of the inclination of the backrest 3 functions entirely without operating mechanisms, such as levers. and the like, and without locking or detent means. Therefore, the operation is especially simple, because no special operation is required. Thus, the adjustment is intuitive and requires no explanation. Furthermore, the construction of the chair 1 is simplified, which leads to a cost savings during the manufacture and furthermore makes it more robust and maintenance friendly.

Changes and modifications in the specifically described embodiments can be carried out without departing from the principles of the present invention, which is intended to be limited only by the scope of the appended claims, as interpreted according to the principles of patent law including the doctrine of equivalents.

LIST OF REFERENCE SYMBOLS

1 chair
2 seat surface
3 backrest
4 leg rest
5 base
6 head piece
7 back piece
8 linkage

9 cross brace
10 lower region of back piece
11 bracket
12 bracket
13 gas pressure spring
14 lever
15 longitudinal brace
16 lever
17 round rod
18 recess
19 brackets

The invention claimed is:

1. A chair comprising:

a backrest and a seat surface;

said backrest being adjustable and relative to said seat surface, said backrest being adjustable in its inclination independently of the position of said backrest relative to said seat surface;

wherein the adjustment of the inclination of said backrest occurs in a stepless manner and without an operating mechanism; and a gas pressure spring adapted to adjust the inclination of said backrest, said gas pressure spring having an initial push-in force that is larger than a subsequent push-in force regardless of a respective position of said backrest relative to said seat surface, and wherein said gas pressure spring has a smaller push-out force than the subsequent push-in force.

2. The chair as claimed in claim 1, wherein said backrest is adapted to be supportable in any desired position relative to said seat surface.

3. The chair as claimed in claim 1, wherein said gas pressure spring comprises a friction gas spring.

4. The chair as claimed in claim 1, wherein one end portion of said gas pressure spring is connected to said backrest and an opposite end of said gas pressure spring is connected to said seat surface.

5. The chair as claimed in claim 4, wherein said gas pressure spring is connected to said seat surface with a longitudinal brace.

6. The chair as claimed in claim 1, wherein said gas pressure spring comprises a gas spring having a piston and a pressure valve on the piston.

7. A chair comprising:

a backrest;

a seat surface, said backrest being adjustable relative to said seat surface, and said backrest having an adjustable inclination independent of the position of said backrest relative to said seat surface, wherein the adjustment of the inclination of said backrest occurs in a stepless manner and without operating mechanisms; and a gas pressure spring connected to said backrest, said gas pressure spring being adapted to adjust said inclination of said backrest, wherein said gas pressure spring has an initial push-in force and a subsequent push-in force, wherein said initial push-in force is larger than said subsequent push-in force regardless of a respective position of said backrest relative to said seat surface and wherein said gas pressure spring has a smaller push-out force than the subsequent push-in force and wherein said gas pressure spring comprises a friction gas spring or a gas pressure spring having a piston and a pressure valve on the piston.

8. The chair as claimed in claim 7, wherein one end portion of said gas pressure spring is connected to said backrest and an opposite end of said gas pressure spring is connected to said seat surface.

9. The chair as claimed in claim 8, wherein said gas pressure spring is connected to said seat surface with a longitudinal brace.

* * * * *